United States Patent [19]

Mayer

[11] 4,156,333

[45] May 29, 1979

[54] PACKAGING MACHINE

[75] Inventor: Rudolf Mayer, Stuttgart-Munster, Fed. Rep. of Germany

[73] Assignee: Robert Bosch GmbH, Stuttgart, Fed. Rep. of Germany

[21] Appl. No.: 772,501

[22] Filed: Feb. 28, 1977

Related U.S. Application Data

[63] Continuation-in-part of Ser. No. 501,223, Aug. 28, 1974, abandoned.

[51] Int. Cl.[2] ..... B65B 11/16; B65B 49/04

[52] U.S. Cl. ..... 53/223; 53/230

[58] Field of Search ..... 53/228, 230, 222, 223, 53/201

[56] References Cited

U.S. PATENT DOCUMENTS

| | | | |
|---|---|---|---|
| 3,150,475 | 9/1964 | Schooler | 53/228 X |
| 3,324,624 | 6/1967 | Mayer | 53/230 |
| 3,372,526 | 3/1968 | Anderson | 53/230 |
| 3,462,915 | 8/1969 | Anderson | 53/230 |
| 3,507,091 | 4/1970 | Mizelle et al. | 53/230 X |

*Primary Examiner*—Travis S. McGehee

*Attorney, Agent, or Firm*—Edward E. Sachs

[57] ABSTRACT

A machine having a folding channel for wrapping blanks of packaging material about substantially rectangular objects that are advanced through the folding channel by a sliding ram. The blanks are introduced across the channel in front of the object before it is moved, and movable folding means are positioned at the output of the folding channel to complete the wrapping. By providing for selective relative positioning of the blank feeder and the movable folding means in conjunction with an appropriate change in the stroke of the ram, a wide variety of object sizes are efficiently accommodated.

4 Claims, 2 Drawing Figures

PACKAGING MACHINE

Figure 1:
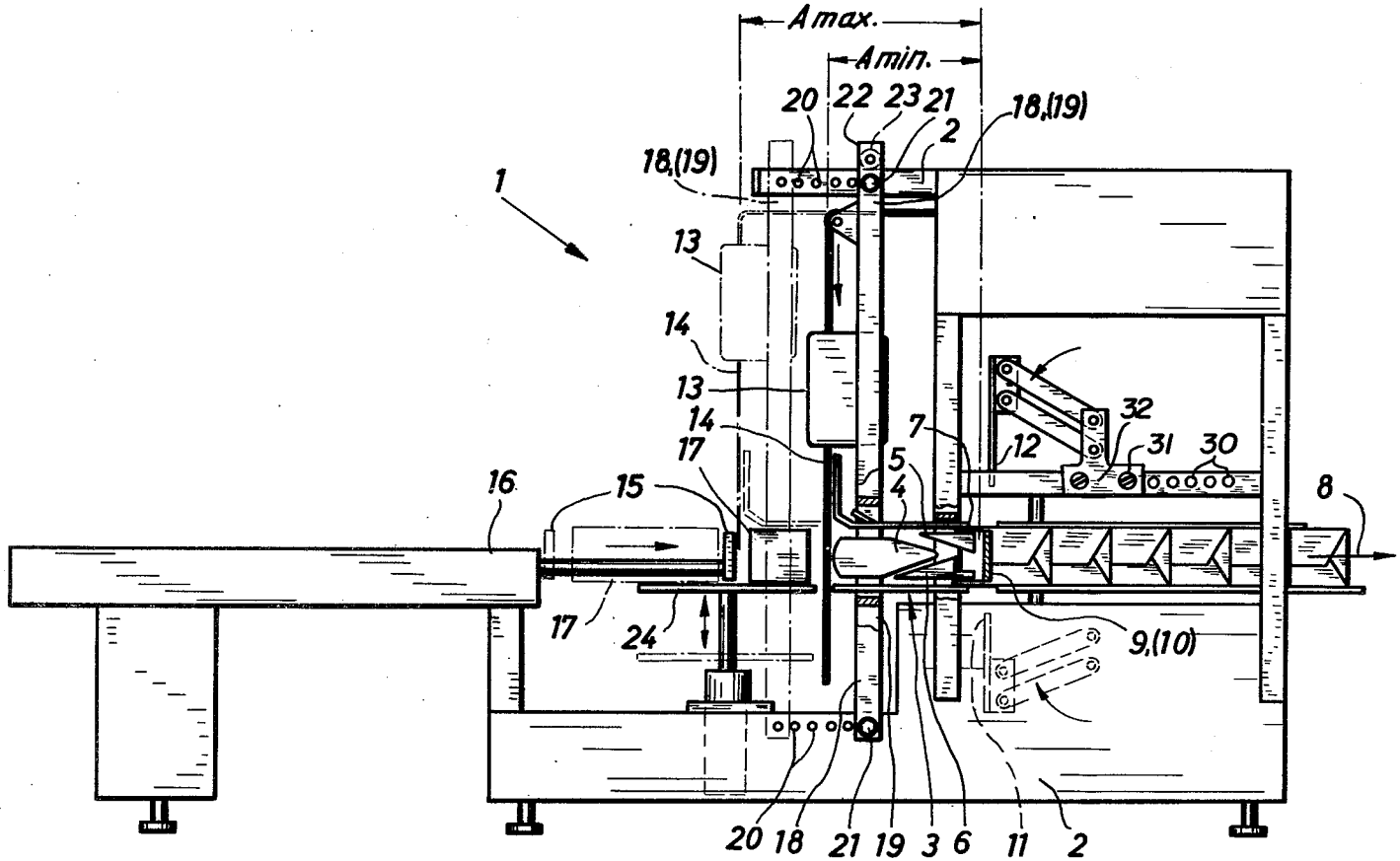

This application is a continuation-in-part application of U.S. application, Ser. No. 501,223, filed Aug. 28, 1974, now abandoned.

The parent application has a priority date based on German Patent Application No. P 23 45 213.3, filed Sept. 7, 1973.

This invention relates to packaging machines, and more particularly to machines for wrapping objects of substantially rectangular cross-section.

A typical prior machine for wrapping an object or group of objects comprises a horizontally extending folding channel, having stationary folding means arranged at the sides of the channel along the planned path of the object. A sliding ram is used to push the object or objects along the folding channel. At the entrance end of the channel, a device is mounted for supplying blanks in a vertical plane. At the remote end of the channel, four folding plates are mounted for movement substantially at right angles to the channel.

In operation a packaging material blank is fed into vertical position across the channel. The ram then pushes the object against the blank and along the folding channel, causing the blank to envelope the object in a "U"-shape around the top, front, and bottom portions. As the object advances past the stationary folding means, the extending sides of the packaging material are folded against the sides of the object which are substantially parallel to the path of the ram. When the object is pushed beyond the folding channel, the sliding ram retreats to its initial position and the four folding plates are activated to move across and complete closure of the rear end of the package.

Machines of this type are usually designed to handle the largest package to be wrapped. Generally, the length of such packages is approximately twice as long as the width, the dimensions of the folding channel and the width of the device feeding the packaging material blanks being selected accordingly. At times, however, it is necessary to wrap relatively long, rod-shaped objects which need wide packaging material blanks but only a short folding channel. Standard machines of this type, however, employ unnecessarily long folding channels, requiring a long ram stroke, and thus a long time to push the elongated object through. This limits the output of the machine. In order to increase the output, it would be necessary to provide a machine in which the principal dimensions are specially matched to the elongated objects being wrapped. This has sharply restricted mass production of inexpensive machines of this type.

An object of the present invention is to provide an improved packaging machine in which the stroke of the sliding ram and folding devices are disposed in direct relationship to the size of the object which is to be wrapped in order to facilitate a high rate, or high capacity, packaging operation.

A more specific object of the present invention resides in providing a machine in which the effective length of the folding channel can be varied so that it is always operating in the most efficient relationship to the length of the object which is to be wrapped. Hence, a short package requires a long stroke and, conversely, a long object requires a short stroke. As a result, the work cycle can be improved or optimized, which is one of the main objects of this invention.

In accordance with the invention, a packaging machine is provided for wrapping objects of substantially rectangular cross-section. This machine comprises a folding channel and means for advancing the object through the channel. Means are provided for supplying packaging material blanks at the upstream end of the channel and orthogonally moving folding means are provided at the downstream end of the channel to complete the wrapping cycle. The distance between the package material supply means and moving folding means is adjustable to permit maximum flexibility in the size of the objects that can be efficiently handled.

An aspect of the present invention resides in providing a packaging machine for wrapping one or more objects. The machine includes a stationary frame which supports a folding channel and a packaging material feeding device which is disposed movable in a longitudinal direction relative to the machine frame and is located upstream of the aforementioned folding channel for introducing blanks of packaging material ortogonally across this folding channel. The machine further includes a movable folding arrangement which is positioned downstream of the folding channel and is operative to move ortogonally to the channel. A ram device which has a selectively predetermined stroke is adapted for advancing the objects to be wrapped through the folding channel in a predetermined direction. The ram device includes a rod which, at one end thereof, is provided with a ram as well as a movable member which is effective for longitudinally moving the rod. Finally, this ram device indluces a position adjustment arrangement which is effective to vary the operational stroke of the rod in relation to the folding channel to permit a correlation of the stroke vis-a-vis the dimension of the object.

For a better understanding of the present invention, together with other and further objects thereof, reference is had to the following description taken in connection with the accompanying drawing, and its scope will be pointed out in the appended claims.

Figure 2:
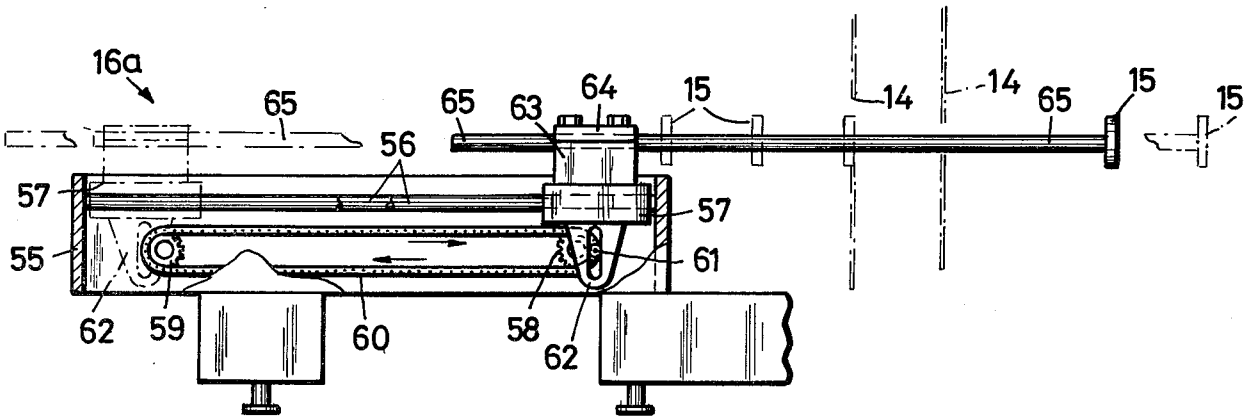

In the drawing:

FIG. 1 is an elevational view of an illustrative embodiment of the invention, and includes broken-away portions to assist in understanding the functioning of certain component parts lying behind the plane of the drawing; and FIG. 2 is a view similar to FIG. 1 showing the drive for the sliding ram.

The packaging machine 1 has a main frame 2, a horizontally extending folding channel 3, and stationary folding means 4, 5, 6 arranged along the folding channel. At the downstream end 7 of the folding channel, folding slides 9, 10, 11 and 12, are mounted to move substantially at right angles to the channel. At the upstream end of channel 3, a device 13 is provided for feeding packaging material blanks 14 in a vertical plane. A sliding ram 15, with a drive means 16, is operative to push object 17, or a group of such objects, through the folding channel.

Device 13 functions in the known manner to place blanks of packaging material across the path of the objects to be wrapped. It is mounted with provision for vertical adjustment on the two columns 18, 19 which are arranged one behind the other in the plane of the drawing. Columns 18, 19, in turn are adjustable on frame 2 in the longitudinal direction 8 of the folding channel 3. In the example illustrated, adjustment is effected by means of rows of attachment holes 20 in frame 2. Thus, columns 18, 19 may be secured to frame 2, by means of bolts 21, at different distances A from moving folding slides 9, 10, 11, 12. It will be appreciated that the attachment holes 20 may also be replaced by clamping means, not shown, which permit infinitely variable adjustment of distance A.

At the upper ends 22 of columns 18, 19, rollers 23 may be mounted to facilitate the convenient alignment of columns 18, 19 and device 13 for feeding blanks of packaging material. Rollers 23 are particularly useful when the distance between device 13 and folding slides 9, 10, 11, 12 has to be altered frequently by the machine operator, in order to wrap several different sizes of objects 17.

The length of the folding channel can be affected by selecting a distance A, i.e., the length between device 13 and the folding slides, with or without a change in the ram stroke. In operation, the object 17 is positioned on table 24. It is then pushed against the packaging material blank 14 by the sliding ram 15 and through folding channel 3 until the rear is aligned with folding slides 9, 10, 11, 12. The distance between columns 18, 19 and folding slides 9, 10, 11, 12 is pre-selected, so that the blanks 14 of packaging material can be correctly folded around objects 17 by stationary folding means 4, 5, 6 and the controlled mobile folding slides 9, 10, 11, 12.

In another embodiment of the present invention, the length of the folding channel is determined by the length of the ram stroke. The device 13 may remain stationary, if desired. A further adjustment may be attained by re-positioning slides 9 to 12 in a longitudinal direction 8 by means of displaceable mounting means 30, 31, 32.

FIG. 2 illustrates in greater detail a drive **16*a* suitable for moving the sliding ram 15 for a predetermined operating distance. This distance or stroke is variable to optimize the operating stroke in direct relation to the size of the object 17 which is to be wrapped. The drive includes a frame 55 mounting two transversely spaced guide rods 56 (only one of which is shown), which slidably carry a carriage 57 which is movable on rods 56**.

The drive **16*a* further includes a set of chain gears 58,59 one of which is positioned proximate to one lengthwise end of frame 55, see 58, and gear 59 is disposed at the opposite end within the frame 55 and in suitable juxtaposition to gear 59 to operably receive an endless chain 60 provided with a drive pin 61 protruding from the chain into a vertically extending slot 62 provided in carriage 57**.

The carriage 57 is provided with a mounting arrangement which includes a clamping holder 63 and clamp 64 to rigidly mount and receive rod 65 which terminates, at the end facing the main structure of the packaging machine shown in FIG. 1, with the sliding ram 15.

More specifically, the guide rods 56 are arranged parallel to fold channel 3 and the gears 58,59 are mounted below the guide rods 56 at an equal vertical distance therefrom.

Actuation of the gears 58,59, for instance by the main drive of the machine (not shown), causes the chain 60 to move along its predetermined path and the integrally connected drive pin 61 reciprocatingly moves the carriage 57 along said path by virtue of engagement therewith in the slotted portion 62 which is formed in a downwardly extending plate of the carriage. Accordingly, rotation of the gear 58 causes the carriage 57, mounting the rod 65, to be moved on and along guide rods 56 relative to the fold channels 3.

The initial and final operating position of the rod 65 and consequently the effective ram stroke, can be readily predetermined and changed. To effect such a change the clamp 64 is loosened. The drive pin 61 and the carriage are then moved into a right hand position as shown in the drawing and the rod 65 within holder 63 is moved in such a manner that the sliding ram is suitably disposed in relation to the work region of folding tools 9 to 12. Upon obtaining the desired rod position, the clamp 64 is again securely tightened to prevent unintentional relative movement between the rod 65 and the carriage 57.

A hydraulic or pneumatic system and structure therefor may be utilized as a substitute for the endless chain 60 to move the rod and ram for a predetermined distance.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. A packaging machine for wrapping an object or objects, comprising a stationary machine frame supporting a folding channel, packaging material feeding means disposed movable in a longitudinal direction relative to said frame and located upstream of said folding channel for introducing blanks of packaging material orthogonally across said folding channel, movable folding means positioned downstream of said folding channel and operative to move orthogonal to said channel, and ram means having a selectively predetermined stroke for advancing said object through said folding channel in a known direction, said ram means comprising a rod having at one end thereof a ram, movable means effective for longitudinally moving said rod, and position adjustment means to vary the affected stroke of the rod in relation to said folding channel, said packaging material feeding means comprising a vertically extending member and engagement means provided on said member for sliding said member along said machine frame along the longitudinal axis of the machine.

2. A packaging machine according to claim 1, wherein said engagement means is a roller mounted to said member at each end thereof.

3. A packaging machine for wrapping an object or objects, comprising a stationary machine frame supporting a folding channel, packaging material feeding means disposed movable in a longitudinal direction relative to said frame and located upstream of said folding channel for introducing blanks of packaging material orthogonally across said folding channel, movable folding means positioned downstream of said folding channel and operative to move orthogonal to said channel, and ram means having a selectively predetermined stroke for advancing said object through said folding channel in a known direction, said ram means comprising a rod having at one end thereof a ram, movable means effective for longitudinally moving said rod, and position adjustment means to vary the effective stroke of the rod in relation to said folding channel, said movable folding means comprising slide plates mounted for movement across said channel and being adjustable to different positions along the longitudinal axis of said folding channel.

4. A packaging machine according to claim 3, wherein said movable folding means includes displaceable mounting means connecting said side plates to said frame.

* * * * *